US012022920B2

(12) United States Patent
Tung et al.

(10) Patent No.: US 12,022,920 B2
(45) Date of Patent: Jul. 2, 2024

(54) ELEMENT MEMBER AND SLIDE FASTENER-ATTACHED PRODUCT

(71) Applicant: YKK Corporation, Tokyo (JP)

(72) Inventors: Yu Chen Tung, Kurobe (JP); Yoshiyuki Sho, Kurobe (JP); Yuko Fukuda, Kurobe (JP)

(73) Assignee: YKK Corporation (JP)

( * ) Notice: Subject to any disclaimer, the term of this patent is extended or adjusted under 35 U.S.C. 154(b) by 298 days.

(21) Appl. No.: 17/619,991

(22) PCT Filed: Jul. 4, 2019

(86) PCT No.: PCT/JP2019/026606

§ 371 (c)(1),
(2) Date: Aug. 26, 2022

(87) PCT Pub. No.: WO2021/001984

PCT Pub. Date: Jan. 7, 2021

(65) Prior Publication Data

US 2023/0013090 A1 Jan. 19, 2023

(51) Int. Cl.
*A44B 19/06* (2006.01)
*A44B 19/40* (2006.01)

(52) U.S. Cl.
CPC ..... *A44B 19/403* (2013.01); *A44B 19/06* (2013.01)

(58) Field of Classification Search
CPC ..... A44B 19/403; A44B 19/06
See application file for complete search history.

(56) References Cited

U.S. PATENT DOCUMENTS 2,720,015 A * 10/1955 Morin ..... A44B 19/04 24/410
3,114,952 A * 12/1963 Morin ..... A44B 19/403 24/410

(Continued)

FOREIGN PATENT DOCUMENTS

CN 2894362 5/2007
CN 103228166 7/2013

(Continued)

OTHER PUBLICATIONS

YKK Corporation; Extended European Search Report for application No. 19936409.2, mailed Jun. 17, 2022, 6 pgs.

(Continued)

*Primary Examiner* — Jason W San
(74) *Attorney, Agent, or Firm* — Taylor English Duma LLP

(57) ABSTRACT

An element member includes a fixing member and a plurality of fastener elements attached to the fixing member, characterized in that the fastener element includes an element fixing portion fixed to the fixing member, a coupling portion extending from the element fixing portion in a width direction, and a fin portion extending from the element fixing portion to a side opposite to the coupling portion. The fastener element is fixed to the fixing member only at the element fixing portion. As a result, in a slide fastener-attached product manufactured by using the element member, the orientation of the fastener element is prevented from being tilted with respect to a fastener attached member and smooth sliding operation of a slider can be ensured.

8 Claims, 12 Drawing Sheets

(56) References Cited

U.S. PATENT DOCUMENTS

| | | | | | |
|---|---|---|---|---|---|
| 4,418,449 | A * | 12/1983 | Heimberger | A44B 19/06 | 24/410 |
| 4,502,190 | A * | 3/1985 | Inamura | A44B 19/32 | 24/389 |
| 4,635,324 | A | 1/1987 | Hoerkens | | |
| 8,359,717 | B2 * | 1/2013 | Yamamoto | A44B 19/32 | 24/411 |
| 9,259,061 | B2 * | 2/2016 | Kojima | A44B 19/06 | |
| 9,301,579 | B2 * | 4/2016 | Fujii | A44B 19/32 | |
| 9,480,311 | B2 * | 11/2016 | Takani | A44B 19/30 | |
| 2005/0217086 | A1 * | 10/2005 | Kusayama | A44B 19/403 | 24/389 |
| 2006/0260104 | A1 * | 11/2006 | Himi | A44B 19/06 | 24/403 |
| 2007/0137006 | A1 * | 6/2007 | Mikuma | A44B 19/32 | 24/403 |
| 2009/0106952 | A1 * | 4/2009 | Lin | A44B 19/308 | 24/418 |
| 2009/0320250 | A1 * | 12/2009 | Yamamoto | A44B 19/32 | 24/389 |
| 2013/0007993 | A1 * | 1/2013 | Kozato | A44B 19/50 | 24/415 |
| 2013/0174388 | A1 | 7/2013 | Ren | | |
| 2014/0020217 | A1 * | 1/2014 | Kojima | A44B 19/36 | 24/436 |
| 2016/0227887 | A1 * | 8/2016 | Kojima | A44B 19/06 | |
| 2016/0338453 | A1 * | 11/2016 | Kojima | A44B 19/06 | |
| 2017/0135445 | A1 * | 5/2017 | Takazawa | A44B 19/06 | |
| 2018/0078005 | A1 | 3/2018 | Tsao | | |
| 2019/0357638 | A1 * | 11/2019 | Sho | A44B 19/28 | |
| 2019/0380454 | A1 * | 12/2019 | Tung | A44B 19/28 | |
| 2020/0085151 | A1 | 3/2020 | Sho | | |
| 2023/0013090 | A1 * | 1/2023 | Tung | A44B 19/403 | |

FOREIGN PATENT DOCUMENTS

| | | | | |
|---|---|---|---|---|
| CN | 206659298 | | 11/2017 | |
| CN | 107898067 | A * | 4/2018 | A44B 19/08 |
| CN | 108056539 | A * | 5/2018 | A44B 19/00 |
| CN | 108402607 | | 8/2018 | |
| JP | S50107305 | U | 9/1975 | |
| JP | 2013081858 | | 5/2013 | |
| JP | 2018047232 | | 3/2018 | |
| TW | 201834576 | | 10/2018 | |
| WO | 2011161784 | | 12/2011 | |
| WO | 2013145257 | | 10/2013 | |
| WO | 2014118948 | | 8/2014 | |
| WO | 2015122018 | | 8/2015 | |
| WO | 2017072926 | | 5/2017 | |
| WO | 2018142548 | | 8/2018 | |

OTHER PUBLICATIONS

YKK Corporation; Office Action for Chinese patent application No. 201980098083.3, mailed Aug. 15, 2023, 21 pgs.

Tung, Yu Chen; International Preliminary Report on Patentability for PCT/JP2019/026606, filed Jul. 4, 2019, mailed Dec. 28, 2021, 9 pgs.

Tung, Yu Chen; International Search Report and Written Opinion for PCT/JP2019/026606, filed Jul. 4, 2019, mailed Oct. 1, 2019, 13 pgs.

YKK Corporation; Office Action for Taiwanese application No. 108142064, mailed Sep. 9, 2020, 18 pgs.

* cited by examiner

ELEMENT MEMBER AND SLIDE FASTENER-ATTACHED PRODUCT

TECHNICAL FIELD

The invention relates to an element member in which a plurality of fastener elements is attached to a fixing member and a slide fastener-attached product in which a pair of two element members is directly attached to a product such as a clothing item.

BACKGROUND ART

Generally, slide fasteners are often used as an opening and closing tool for products such as clothing items, commodity goods, and industrial materials, and for products such as various seats in automobiles, trains and aircrafts. Such a slide fastener used for various products generally has a right and left pair of fastener stringers in which element rows are formed at tape side edge parts of fastener tapes and a slider sliding along the right and left element rows. In addition, as one of the slide fasteners, a slide fastener provided with a separable rear end stop capable of disengaging and separating the right and left fastener stringers is known.

In the conventional slide fasteners and fastener stringers, for example, an injection-molded synthetic resin fastener element or the like is attached to a tape side edge part of a fastener tape, so that an element row is formed at the tape side edge part. In addition, when the slide fastener is attached to a fastener attached member such as a clothing item, in general, a part (generally called as a tape main body portion) except for the tape side edge part of the fastener tape is put on a fastener attaching portion of the fastener attached member, and they are sewn together with a sewing machine. Therefore, in general slide fasteners, a fastener tape is commonly used as an essential member (component) to constitute a slide fastener.

Meanwhile, WO 2018/142548 A (Patent Document 1), for example, describes a slide fastener-attached product in which a slide fastener is configured without using a fastener tape and a separable rear end stop is formed at a predetermined position.

For example, in a slide fastener-attached product described in Patent Document 1, an element member 80 as shown in FIG. 16 is sewn to each of right and left cloths 90 forming clothing. Each of the right and left element members 80 includes a string-shaped fixing member (connecting member) 81 and a plurality of fastener elements 82 made of synthetic resin and fixed to the fixing member 81.

Each of the fastener elements 82 of the element member 80 is formed in a predetermined shape by injection molding. The fastener element 82 includes an element body portion fixed to the fixing member 81, an element neck portion extending from the element body portion and having a constricted shape, a coupling head portion further extending from the element neck portion, and a protruded piece portion (also referred to as a shoulder portion) protruding in a thin plate shape forward and backward in the length direction from the element neck portion. Such right and left element members 80 are fixed to element attaching edge parts of the cloths 90 by sewn portions for fixing 85 and auxiliary sewn portions 86 formed by sewing of a sewing machine.

In a slide fastener-attached product of Patent Document 1 such as a clothing in which the right and left element members 80 are directly sewn to the cloths 90 as described above, a fastener tape, which is essential in a conventional general slide fastener, is not required, so that weight reduction and flexibility of the product can be improved.

PRIOR ART DOCUMENT

Patent Document

Patent Document 1: WO 2018/142548 A

SUMMARY OF INVENTION

Problem to be Solved by the Invention

In the case of the slide fastener-attached product described in Patent Document 1, the element member 80 is fixed to the cloth 90 by wrapping and holding the fixing member 81 exposed between the fastener elements 82 with a sewing thread of the sewn portion for fixing 85. In this case, the element member 80 is fixed such that the upper surface and the lower surface of the fastener element 82 are parallel to the surface of the cloth 90.

However, since the element member 80 is fixed to the cloth 90 by holding the fixing member 81 with the sewing thread, for example, when the element member 80 receives an external force in the top and back direction of the cloth 90, the orientation of some fastener elements 82 may tilt about the fixing member 81 so that the upper surface and the lower surface of the fastener elements 82 are inclined with respect to the surface of the cloth 90 while the element member 80 is attached to the cloth 90. When the orientation of the fastener elements 82 is tilted as described above, the fastener elements 82 are easily caught by the slider, so that there is a problem that trouble occurs in the sliding operation of the slider.

In addition, in the case of the slide fastener-attached product of Patent Document 1, the sewing thread of the sewn portion for fixing 85 or the sewing thread of the auxiliary sewn portion 86 that fixes the element member 80 to the cloth 90 is disposed at a position where it is easily rubbed against upper flange portions and lower flange portions of the slider when the slider slides. Therefore, it is also conceivable to cause the cutting of the sewing thread by repeatedly performing the sliding operation of the slider.

Furthermore, right and left opposing edge parts of the cloths 90 to which the element members 80 are attached may be formed by folding back end portions of the cloths 90 in order to make it difficult to fray. In this case, the thickness (dimension in the top and back direction) of the opposing edge parts of the cloths 90 increases. However, since the opposing edge parts of the cloths 90 are inserted into a gap formed between the upper flange portion and the lower flange portion of the slider when the slider is slid, when the thickness of the opposing edge parts increases, there is also a possibility that defects such as making the sliding of the slider heavy and capture of the cloths 90 into the slider occur.

In addition, in the case of performing sewing processing of sewing the element member 80 of Patent Document 1 to a fastener attached member (for example, cloth 90 of clothing) of a product using a sewing machine, a tooth of a feeding gear (for example, the tooth 51 of a feeding gear 50 shown in FIG. 17) of the sewing machine is inserted between the adjacent fastener elements 82 of the element member 80, and the fastener elements 82 are supported while being fed by the feeding gear, so that the element member 80 is prevented from swinging or twisting in the right and left direction during the sewing processing. However, it is desired to further improve the workability and work efficiency of the sewing processing by more stably feeding and supporting the element member with such a feeding gear.

The invention has been made in view of the above conventional problems, and an object of the invention is to provide an element member capable of making an orientation of a fastener element hardly tilted even when the element member receives an external force in a slide fastener-attached product, and a slide fastener-attached product to which the element member is attached. Furthermore, a secondary object is to provide an element member capable of making it difficult to cause defects such as cutting of a sewing thread due to friction with a slider, capable of making it difficult to cause defects such as a decrease in slidability of the slider and capture of cloth into the slider due to the thickness of a fastener attached member, or capable of stably performing sewing processing with respect to the fastener attached member, and a slide fastener-attached product to which the element member is attached.

Means for Solving the Problems

In order to achieve the above object, an element member provided by the invention includes a fixing member and a plurality of fastener elements attached to the fixing member, characterized in that the fastener element includes an element fixing portion fixed to the fixing member, a coupling portion extending from the element fixing portion in a width direction orthogonal to a length direction of the fixing member, and a fin portion extending from the element fixing portion to a side opposite to the coupling portion, and the fastener element is fixed to the fixing member only at the element fixing portion.

In the element member of the invention, the fin portion preferably has one through-hole penetrating in a height direction orthogonal to the length direction and the width direction.

In addition, the fin portion preferably has a first fin surface and a second fin surface orthogonal to the height direction, and an accommodating recessed groove portion provided along the length direction on any one of the first fin surface and the second fin surface.

In the element member of the invention, it is preferable that the fastener element includes a first element half portion disposed on one side in the height direction orthogonal to the length direction and the width direction and a second element half portion disposed on the other side in the height direction, the first element half portion and the second element half portion have asymmetric shapes in the height direction each other, and the first element half portion includes an element body portion forming a part of the element fixing portion, and an element neck portion and a coupling head portion forming the coupling portion.

In this case, it is preferable that the second element half portion includes an element base portion forming the element fixing portion together with the element body portion, and an element extending portion extending from the element base portion in the width direction, the element base portion is formed to have a constant size in length dimension in a range of 80% or more in a fixing region in the width direction fixed to the fixing member of the element base portion when the fastener element is viewed from one side in the height direction, and a length dimension of the element extending portion gradually decreases in a direction away from the element base portion.

Furthermore, it is preferable that the fastener element has a first end surface of the first element half portion disposed on one side in the height direction and a second end surface of the second element half portion disposed on the other side in the height direction, and a step between the first end surface of the first element half portion and the fin portion in the height direction is larger than a step between the second end surface of the second element half portion and the fin portion in the height direction.

Next, a slide fastener-attached product provided by the invention is characterized by including a pair of two element members having the above-described features, a fastener attached member including a pair of element attaching edge parts to which the element member is attached each provided at positions facing each other, and a slider slidably attached to element rows formed by the plurality of fastener elements.

In the slide fastener-attached product of the invention, it is preferable that the slider includes an upper blade, a lower blade disposed apart from the upper blade, a connecting column connecting one end part of the upper blade and one end part of the lower blade, and lower flange portions disposed at right and left side edge parts of the lower blade, and right and left side end edges of the upper blade are disposed inside right and left side end edges of the lower blade in a width direction in a plan view of the slider viewed from above.

Effects of the Invention

In the element member of the invention, each fastener element includes at least an element fixing portion fixed to a fixing member, a coupling portion extending from the element fixing portion and capable of coupling with a fastener element, which is a coupling counterpart, and a fin portion extending in a plate shape from the element fixing portion to a side opposite to the coupling portion. In addition, the fastener element of the invention is fixed to the fixing member only at the element fixing portion, and the coupling portion and the fin portion of the fastener element are not directly fixed to the fixing member. With such an element member of the invention, when the element member is sewn to the fastener attached member of the product, the fin portion of each fastener element can be fixed by a sewn portion in a state of being in surface contact with the fastener attached member.

Therefore, for example, in a slide fastener-attached product manufactured using the element member of the invention, when the element member receives an external force, the orientation of the fastener element can be prevented from being tilted with respect to the fastener attached member by the fin portion fixed in contact with the fastener attached member. As a result, since the fastener element is hardly caught by the slider due to the tilt of its orientation, smooth sliding operation of the slider can be ensured, and the slide fastener integrally formed with the product can be stably opened and closed.

In such an element member of the invention, the fin portion of the fastener element has one through-hole penetrating in the height direction of the fastener element. Thus, when the sewing processing of sewing the element member to the fastener attached member of the product is performed, the element member can be sewn to the fastener attached member while passing a sewing needle through the through-hole formed in the fin portion, so that the fin portion of the fastener element can be firmly and stably fixed by the sewn portion. Therefore, it is possible to prevent the orientation of the fastener element more effectively from being tilted with respect to the fastener attached member.

In addition, the fin portion of the invention has a first fin surface and a second fin surface orthogonal to the height direction, and an accommodating recessed groove portion recessed along a length direction on any one of the first fin surface and the second fin surface. Thus, in the product in which the element member is sewn to the fastener attached member, a part of the sewn portion can be accommodated and held in the accommodating recessed groove portion of the fin portion. Therefore, since the sewn portion held in the accommodating recessed groove portion of the fin portion can be made less likely to come into contact with the slider, cutting of the sewing thread due to the contact with the slider can be made less likely to occur even when the sliding operation of the slider is repeatedly performed.

In the element member of the invention, the fastener element includes a first element half portion disposed on one side in the height direction and a second element half portion disposed on the other side in the height direction. The first element half portion and the second element half portion have asymmetric shapes in the height direction each other. In addition, the first element half portion includes an element body portion forming a part of the element fixing portion, and an element neck portion and a coupling head portion forming a coupling portion.

Since each of the fastener elements has the above-described form, the right and left fastener elements can be stably coupled. In addition, the coupling state of the fastener elements can be stably maintained. Furthermore, the second element half portion can be formed in a form having no coupling portion, so that a slide fastener-attached product excellent in appearance quality can be manufactured.

In this case, the second element half portion includes an element base portion forming the element fixing portion together with the element body portion of the first element half portion, and an element extending portion extending in the width direction from the element base portion. In addition, the element base portion is formed to have a constant size in length dimension in a range of 80% or more, preferably in a range of 100% or more in the fixing region in the width direction fixed to the fixing member of the element base portion when the fastener element is viewed from the other side in the height direction. The element extending portion is formed in a form in which the length dimension is continuously gradually reduced in a direction away from the element base portion.

Since the second element half portion is formed as described above, the length dimension of an interval formed between the adjacent second element half portions of the element member can be gradually increased in a direction away from the fixing member. Accordingly, when the element member of the invention is sewn to the fastener attached member of the product using the sewing machine, the teeth of the feeding gear of the sewing machine can be deeply inserted between the second element half portions of the fastener elements, for example, as compared with the element member 80 of Patent Document 1. Therefore, the fastener elements can be more stably supported by the feeding gear. Thus, the sewing processing of the element member can be performed more stably, so that the workability and work efficiency of the sewing processing can be enhanced.

In addition, the fastener element of the invention includes a first end surface of the first element half portion disposed on one side in the height direction and a second end surface of the second element half portion disposed on the other side in the height direction. In this case, a step between the first end surface of the first element half portion and the fin portion in the height direction is larger than a step between the second end surface of the second element half portion and the fin portion in the height direction. That is, a height dimension between the first end surface disposed on one side in the height direction of the first element half portion and the first fin surface disposed on one side in the height direction of the fin portion is set to be larger than a height dimension between the second end surface disposed on the other side in the height direction of the second element half portion and the second fin surface disposed on the other side in the height direction of the fin portion. Thus, in the slide fastener-attached product manufactured using the element member of the invention, when the slider is slid in a direction of closing the slide fastener, the flange portions provided on the slider can be stably slid and brought into contact with the first element half portion provided with the coupling portion, so that the right and left fastener elements can be smoothly and stably coupled.

Next, the slide fastener-attached product according to the invention includes the pair of two element members having the above-described features, the fastener attached members including a pair of element attaching edge parts to which the element member is attached each provided at positions facing each other, and the slider slidably attached to element rows formed by a plurality of fastener elements. According to such a slide fastener-attached product of the invention, when the element member receives an external force in the top and back direction of the cloth 2, it is possible to prevent the orientation of the fastener element from being tilted with respect to the fastener attached member as described above. As a result, the slider can be smoothly slid, so that the slide fastener can be stably opened and closed. In addition, even when the sliding operation of the slider is repeatedly performed, the cutting of the sewing thread due to contact with the slider can be made less likely to occur.

In such a slide fastener-attached product of the invention, the slider includes an upper blade, a lower blade disposed apart from the upper blade, a connecting column connecting one end part of the upper blade and one end part of the lower blade, and right and left lower flange portions disposed at right and left side edge parts of the lower blade. In particular, in the invention, the right and left side end edges of the upper blade are disposed inside right and left side end edges of the lower blade in the width direction in a plan view of the slider viewed from above.

By including such a slider, even when the fastener attached member is formed thick, it is possible to prevent the slidability of the slider from deteriorating due to the thick fastener attached member. In addition, it is possible to unfailingly prevent the thick fastener attached member from being caught by the slider during sliding of the slider.

DESCRIPTION OF EMBODIMENTS

Hereinafter, preferred embodiments of the invention will be described in detail with reference to the drawings by way of examples.

Note that, in each of the following examples, a case where the slide fastener-attached product is a slide fastener-attached clothing will be described, but the slide fastener-attached product according to the invention includes not only clothing (clothing items) but also various products such as daily goods such as shoes and bags, products such as industrial materials, and various seats such as automobiles, trains, and aircrafts.

EXAMPLES

Figure 1:
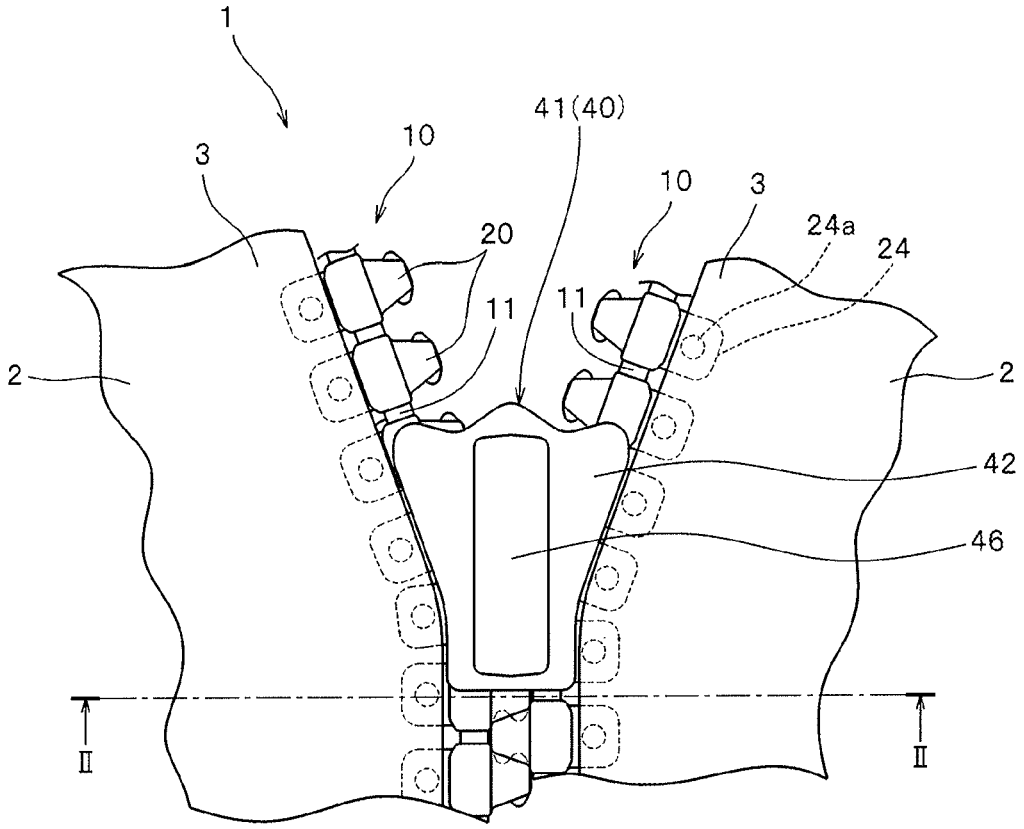
FIG. 1 is a plan view schematically showing a main part of a slide fastener-attached product (clothing) according to an example of the invention.
Figure 2:
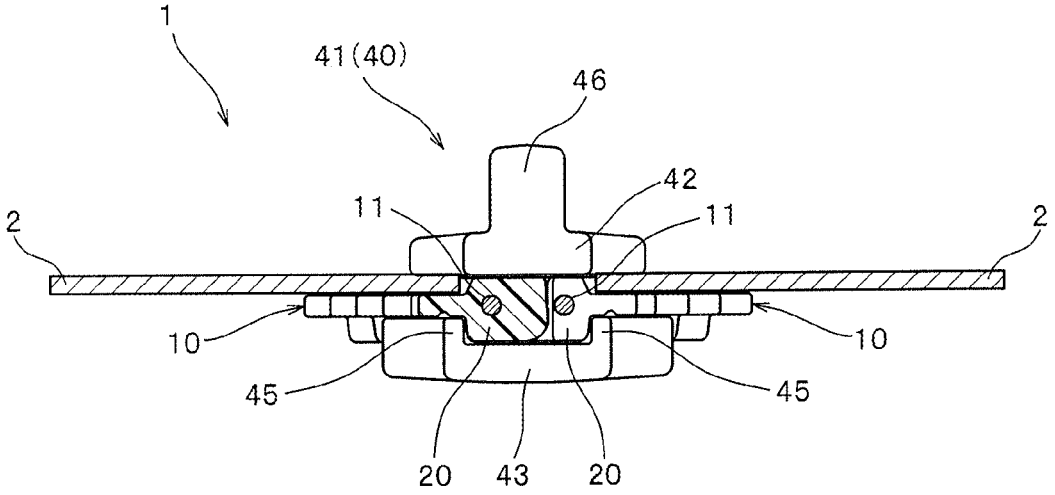
FIG. 2 is a cross-sectional view taken along line II-II shown in FIG. 1.
Figure 3:
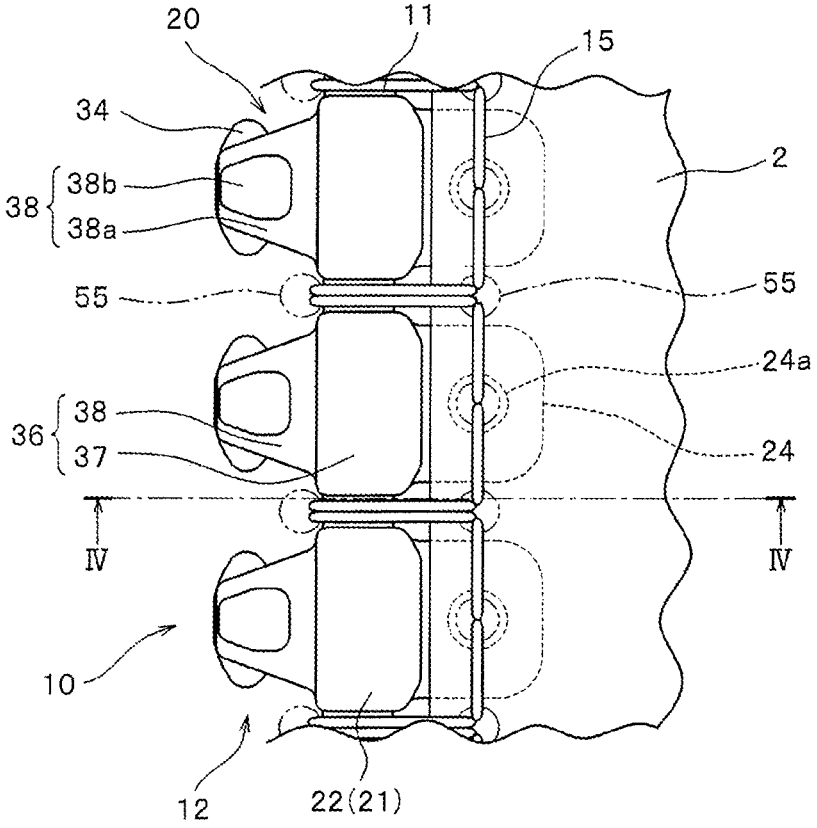
FIG. 3 is a plan view schematically showing a state in which an element member is fixed to a fastener attached member (cloth) by a sewn portion.
Figure 4:
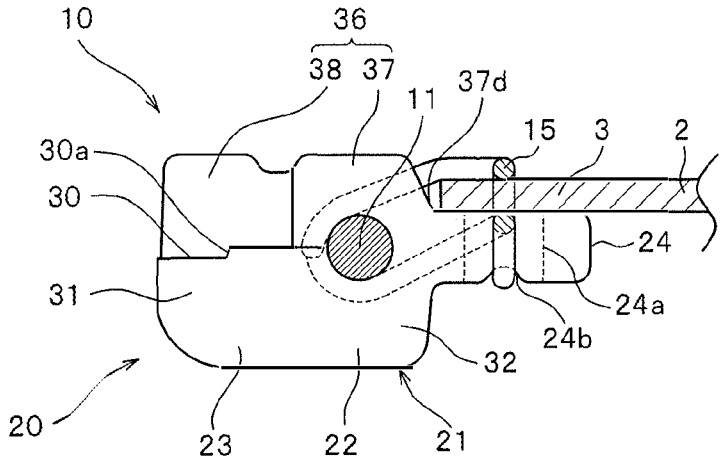
FIG. 4 is a cross-sectional view taken along line IV-IV shown in FIG. 3.
Figure 5:
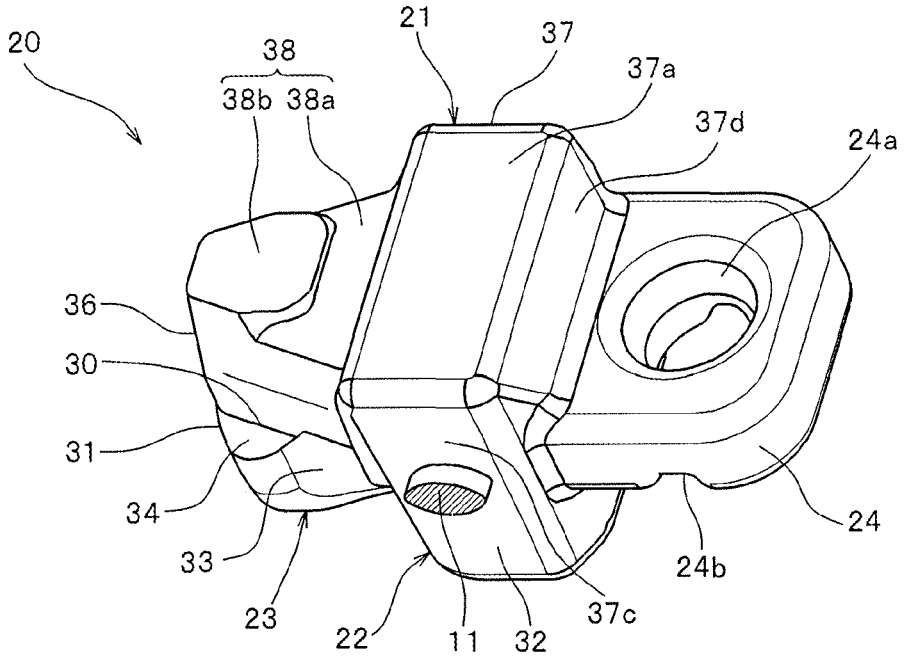
FIG. 5 is a perspective view showing only a fastener element.
Figure 6:
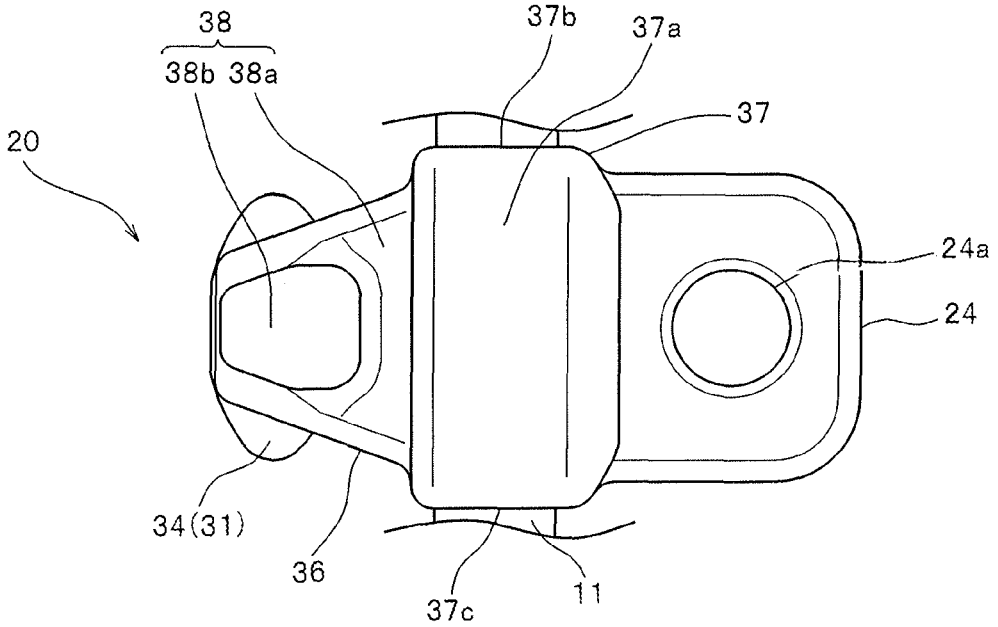
FIG. 6 is a plan view of the fastener element shown in FIG. 5 as viewed from above.
Figure 7:
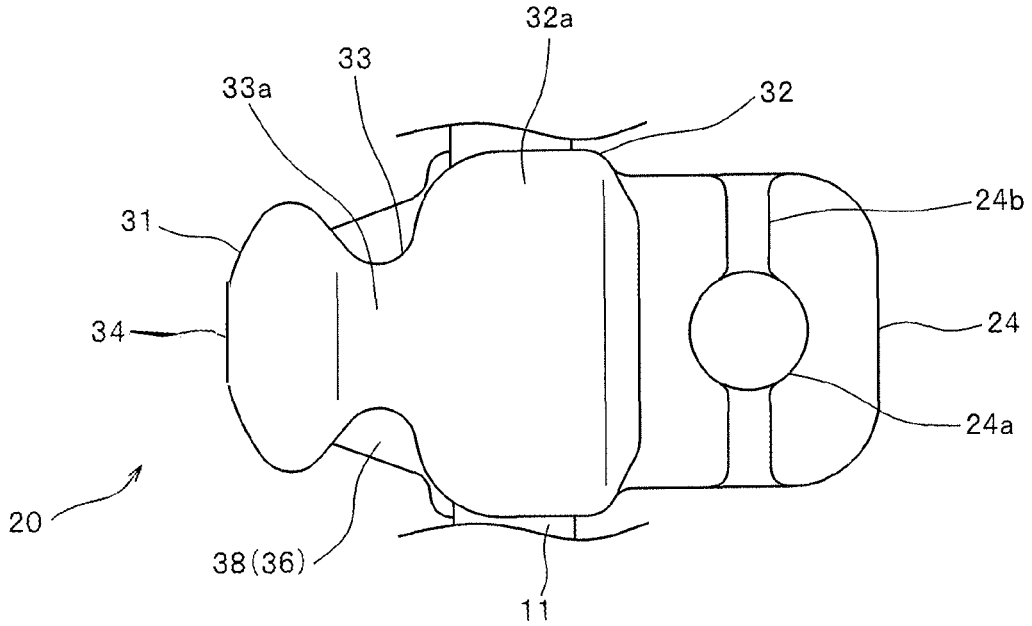
FIG. 7 is a bottom view of the fastener element shown in FIG. 5 as viewed from below.
Figure 10:
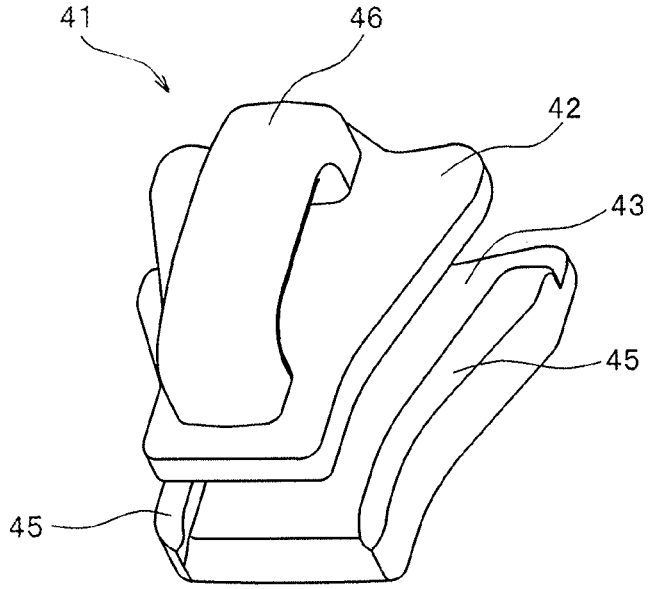
FIG. 10 is a perspective view showing only a slider body of a slider.
Figure 11:
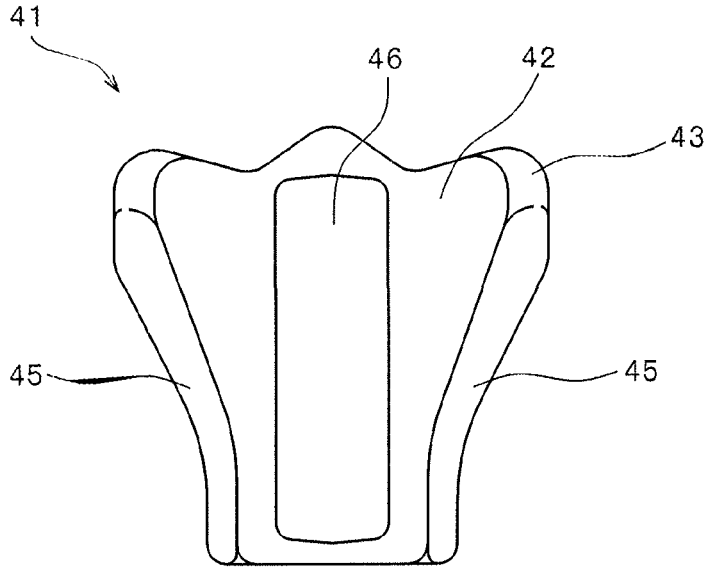
FIG. 11 is a plan view of the slider body shown in FIG. 10 as viewed from above.
Figure 12:
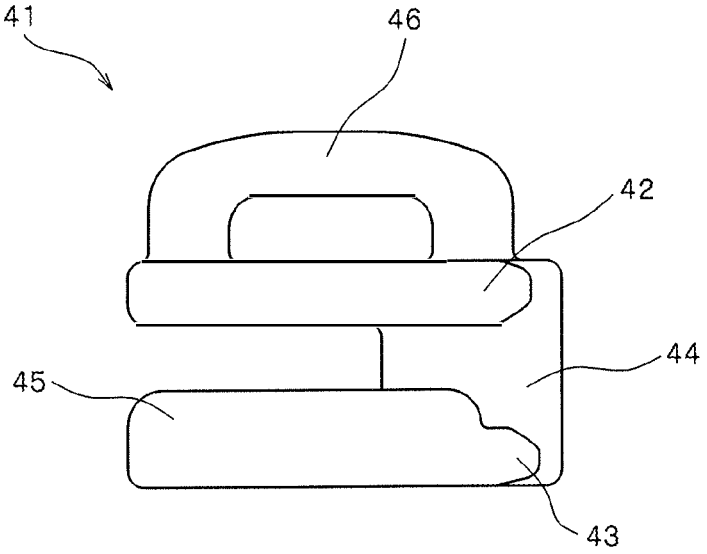
FIG. 12 is a side view of the slider body shown in FIG. 10 as viewed in a width direction.

FIG. 1 is a plan view schematically showing a main part of a slide fastener-attached clothing according to the present example, and FIG. 2 is a cross-sectional view taken along line II-II shown in FIG. 1. Note that, in FIGS. 1 and 2, illustration of a sewn portion for fixing the element member is omitted. FIG. 3 is a plan view schematically showing a state in which the element member is fixed to a cloth by the sewn portion, and FIG. 4 is a cross-sectional view taken along line IV-IV shown in FIG. 3. FIGS. 5 to 9 are schematic views of the fastener element as viewed from various directions, and FIGS. 10 to 12 are schematic views of the slider body as viewed from various directions.

In addition, in the following description, the front and rear direction refers to a length direction of the element member parallel to the sliding direction of the slider, and in particular, a direction in which the slider slides so as to couple the right and left element rows is referred to as the front direction and a direction in which the slider slides so as to separate the right and left element rows is referred to as the rear direction. Note that the length direction of the element member may be abbreviated as the length direction.

The right and left direction refers to a direction in which a pair of element members is arranged in a slide fastener-attached clothing. In addition, the right and left direction is a direction orthogonal to the sliding direction of the slider and parallel to the top surface and the back surface of the cloth, which is a fastener attached member, and can also be referred to as a width direction of the element member.

The upper and lower direction refers to a direction orthogonal to the front and rear direction and the right and left direction, and for example, refers to a height direction (or a thickness direction) of the element member orthogonal to the top surface and the back surface of a cloth, which is a fastener attached member. In particular, in this case, the direction toward an outer surface side of the cloth when the clothing is manufactured is referred to as an upper side, and the opposite direction is referred to as a lower side. More specifically, in the case of the present example, the front and rear direction is an upper and lower direction on the sheet of paper of FIG. 1, and the right and left direction is a right and left direction on the sheet of paper of FIG. 2. In addition, the upper and lower direction is an upper and lower direction on the sheet of paper of FIG. 2.

The slide fastener-attached product according to Present Example 1 is a slide fastener-attached clothing 1, and right and left element attaching edge parts 3 are provided on a front body (in particular, the front placket part) serving as an opening and closing portion of the clothing 1 so as to face each other. In addition, by sewing element members 10 to the right and left element attaching edge parts 3 of the clothing 1, right and left element rows 12 including a plurality of fastener elements 20 of the element members 10 are formed. In this case, the cloth 2 (also referred to as a garment cloth) forming the front placket part of the clothing 1 is a fastener attached member to which the element members 10 are attached. Furthermore, a slider 40 is attached to the right and left element rows 12 so as to be slidable along the element rows 12.

In this case, the right and left element attaching edge parts 3 are formed by folding back side end edges serving as cut end parts of the cloth 2 in a U shape in the right and left direction. As a result, since the element attaching edge parts 3 are formed thick, the strength of the element attaching edge parts 3 is enhanced. In addition, even when fraying occurs in the side end edge of the cloth 2, the fraying can be hidden on the back surface side of the element attaching edge part 3, so that it is possible to prevent the coupling of the element rows 12 from being deteriorated due to the fraying and trouble from occurring in the sliding operation of the slider 40. Note that the element attaching edge parts 3 being thick means that the element attaching edge parts 3 have a large thickness dimension (dimension in the thickness direction). Note that, in the invention, the cloth 2 of the clothing 1 is not particularly limited, and can be appropriately selected.

The right and left element members 10 of the present example are arranged substantially parallel to each other in the width direction and sewn along the length direction to the right and left element attaching edge parts 3 of the clothing 1. Each of the right and left element members 10 has a plurality of independent fastener elements 20 (also referred to as independent elements) and one string-shaped fixing member 11 (also referred to as a connecting member) that connects the plurality of fastener elements 20 at a constant interval.

The fixing member 11 of Present Example 1 is a cord (also called as a knit cord) formed by wrapping a core yarn formed of a plurality of aligned multifilaments with a hollow weave part knitted with a plurality of knitting yarns, and has flexibility. Note that the fixing member 11 used in the invention is not particularly limited as long as a plurality of fastener elements can be attached, and may be formed of, for example, a monofilament or a twisted yarn (twisted cord). In addition, the cross-sectional shape of the fixing member 11 is also not particularly limited. Furthermore, in the invention, one element member may be formed by attaching a plurality of fastener elements to two or more fixing members arranged in parallel.

In each of the element members 10, the plurality of fastener elements 20 is fixed to the fixing member 11 at equal intervals so as to be in the same orientation (direction) along the length direction of the fixing member 11. These fastener elements 20 are formed integrally with the fixing member 11 by, for example, injection molding thermoplastic resin such as polyamide, polyacetal, polypropylene, or polybutylene terephthalate into one fixing member 11.

Note that, in the invention, the material of the fastener element is not limited to the thermoplastic resin described above, and for example, the fastener element can be formed of another synthetic resin or metal. In addition, the element member of the invention is not limited to that obtained by directly injection molding the fastener element with the fixing member, and includes, for example, that in which a plurality of fastener elements formed in a predetermined shape in advance is fixed to the fixing member by welding or adhesion, or that in which fastener elements are attached to the fixing member using plastic deformation of fastener elements by pressing.

As shown in FIGS. 5 to 9, each of the fastener elements 20 of the present example includes an element main body portion 21 formed by wrapping the fixing member 11 inside, and a fin portion 24 extending in a plate shape from the element main body portion 21 toward the inside of the cloth 2 in the width direction.

In this case, the element main body portion 21 includes at least an element fixing portion 22 fixed to the fixing member 11 and a coupling portion 23 that extends from the element fixing portion 22 toward an outer side of the cloth 2 in the width direction (element member 10 side, which is a coupling counterpart) and is coupled with the fastener element 20, which is a coupling counterpart. In addition, the fixing member 11 is disposed to penetrate the element fixing portion 22 in the front and rear direction, and is not inserted into the coupling portion 23 or the fin portion 24 of the fastener element 20. Therefore, each of the fastener elements 20 is fixed to the fixing member 11 by holding only the element fixing portion 22 to the fixing member 11.

The element main body portion 21 of the present example includes a first element half portion (element lower half portion) 31 disposed on a lower side in the height direction and a second element half portion (element upper half portion) 36 disposed on an upper side in the height direction and having a shape asymmetric with respect to the first element half portion 31 in the height direction. In this case, in the height direction of the fastener element 20, a boundary 30 between the first element half portion 31 and the second element half portion 36 in the element main body portion 21 is included in the formation range (range in the height direction from the upper surface to the lower surface of the fin portion 24) in which the fin portion 24 is formed.

The first element half portion 31 of Present Example 1 includes an element body portion 32 wrapping the fixing member 11 together with the second element half portion 36, an element neck portion 33 extending from the element body portion 32 in the width direction of the element member 10 and having a constricted shape such that the length dimension (dimension in the length direction) becomes the smallest at a predetermined position, and a coupling head portion 34 extending from the element neck portion 33 in the width direction. The coupling head portion 34 has a substantially oval shape in a bottom view of the element member 10 viewed from below. In such a first element half portion 31, the element neck portion 33 and the coupling head portion 34 form the coupling portion 23 to be engaged with the fastener elements 20 of the element member 10, which is a coupling counterpart.

In Present Example 1, the element body portion 32 and the element neck portion 33 have lower surfaces (first element surfaces) 32*a* and 33*a* disposed orthogonal to the thickness direction, and the lower surface 32*a* of the element body portion 32 and the lower surface 33*a* of the element neck portion 33 are formed on a single continuous flat surface. The lower surface of the coupling head portion 34 is formed as a curved surface in which the thickness dimension of the first element half portion 31 gradually decreases as it goes away from the cloth 2 in a front view (FIG. 8) of the fastener element 20. In addition, when the fastener element 20 is viewed from the coupling head portion 34 side, a front surface portion and a rear surface portion of the coupling head portion 34 have curved surfaces that gradually reduce the thickness dimension of the coupling head portion 34 toward the front side or rear side.

Furthermore, in the fastener element 20 of Present Example 1, the boundary 30 between the first element half portion 31 and the second element half portion 36 is formed such that a step 30*a* is provided between the element neck portion 33 and the coupling head portion 34 of the first element half portion 31. In this case, the boundary 30 formed in the coupling head portion 34 is disposed at a position below the boundary 30 formed in the element neck portion 33 (a position close to the lower surface of the first element half portion 31). Accordingly, when the right and left fastener elements 20 are coupled by sliding the slider 40, the coupling head portion 34 can be easily inserted and fitted into the element neck portion 33 of the fastener element 20, which is the coupling counterpart.

The second element half portion 36 includes an element base portion 37 that forms the element fixing portion 22 by wrapping the fixing member 11 together with the element body portion 32 of the first element half portion 31, and an element extending portion 38 extending from the element base portion 37 in the width direction of the element member 10. The element base portion 37 of the second element half portion 36 has a substantially rectangular parallelepiped form. In this case, the element body portion 32 of the first element half portion 31 and the element base portion 37 of the second element half portion 36 form the element fixing portion 22 fixed to the fixing member 11 of the fastener element 20.

In particular, the element base portion 37 of the present example has an upper surface (second element surface) 37*a* disposed parallel to the lower surfaces 32*a* and 33*a* of the element body portion 32 and the element neck portion 33, and has a front end surface 37*b* and a rear end surface 37*c* formed parallel to each other and along the width direction. In this case, the length dimension between the front end surface 37*b* and the rear end surface 37*c* of the element base portion 37 is set to a constant size in a range of 80% or more, preferably in a range of 100% or more in the fixing region in the width direction fixed to the fixing member 11 of the element base portion 37 in a plan view (FIG. 6) of the fastener element 20 viewed from above. In other words, a width dimension (dimension in the width direction) of the flat front end surface 37*b* and the flat rear end surface 37*c* of the element base portion 37 has a size of 80% or more, preferably a size of 100% or more of the width dimension of the fixing member 11 in a plan view of the fastener element 20. Note that the fixing region in the width direction of the element base portion 37 fixed to the fixing member 11 can also be referred to as an arrangement region in the width direction of the fixing member 11.

Thus, when the fastener element 20 shrinks as a result of cooling after the injection molding of the fastener element 20, it is possible to prevent the occurrence of a difference in thermal shrinkage amount in the length direction of the element base portion 37 between the end portion on one side in the width direction and the end portion on the other side in the width direction of the fixing member 11, or it is possible to make the difference in thermal shrinkage amount hardly occurs. Here, for example, in a case where the above-described difference in the shrinkage amount of the fastener element occurs between the end portion on one side in the width direction and the end portion on the other side in the width direction of the fixing member 11, there is a possibility that the element member obtained after cooling the fastener element is formed in a form curved so as to warp toward one side (left side or right side) in the width direction.

On the other hand, in the case of the present example, the element base portion 37 of the second element half portion 36 is formed so that a difference in the shrinkage amount of the fastener element 20 does not occur or hardly occurs between the end portion on one side in the width direction and the end portion on the other side in the width direction of the fixing member 11. Therefore, the element member 10 is hardly formed in the curved form as described above due to the shrinkage of the fastener element 20, and can stably have a linear form extending straight in the front and rear direction.

In addition, the fastener element 20 of the present example is formed such that the height dimension (in particular, the minimum value of the height dimension) from the upper surface 37*a* of the element base portion 37 to the fixing member 11 is smaller than the height dimension (in particular, the minimum value of the height dimension) from the lower surface 32*a* of the element body portion 32 in the first element half portion 31 to the fixing member 11.

Figure 8:
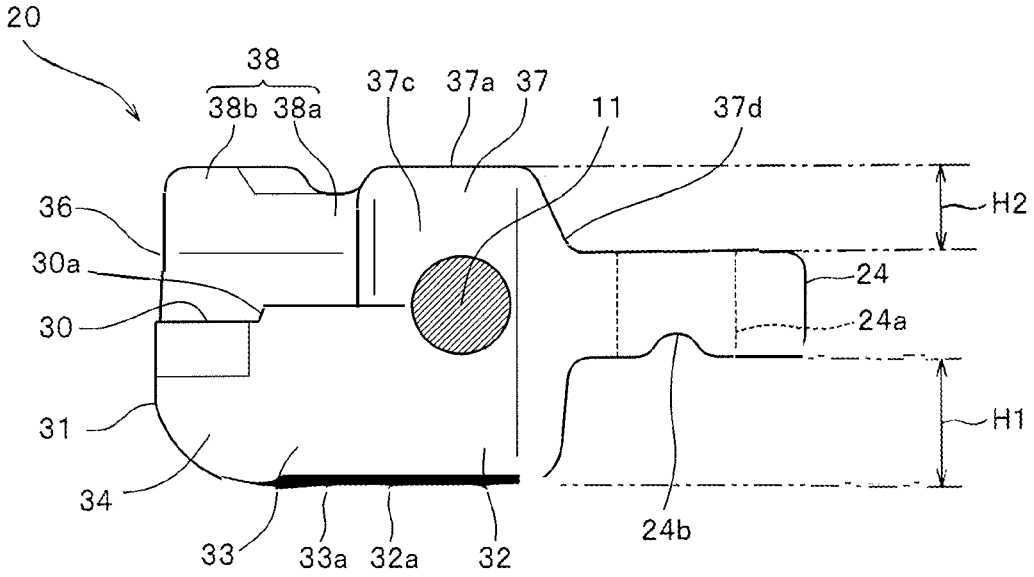
FIG. 8 is a front view of the fastener element shown in FIG. 5 as viewed from a length direction.
Figure 9:
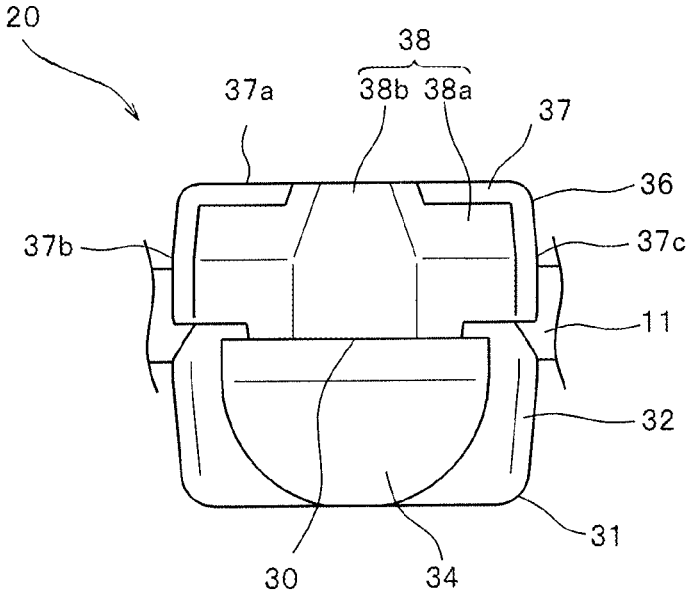
FIG. 9 is a side view of the fastener element shown in FIG. 5 as viewed from a coupling head portion side in a width direction.

Furthermore, as shown in FIGS. 4 and 8, for example, the element base portion 37 of the present example has a fin-side side surface portion 37*d* inclined downward in the width direction from the upper surface 37*a* of the element base portion 37 toward the upper surface of the fin portion 24. For example, as will be described below, when the cloth 2 is placed on the upper surface of the fin portion 24 of the fastener element 20 and the sewing processing is performed with respect to the element member 10 and the cloth 2, the element member 10 can be positioned with respect to the cloth 2 by bringing a side surface portion of the cloth 2 into contact with the fin-side side surface portion 37*d* (in other words, the step between the upper surface 37*a* of the element base portion 37 and the upper surface of the fin portion 24) of the element base portion 37.

Note that the fin-side side surface portion 37*d* may be formed not by an inclined surface inclined downward in the width direction as described above, but by a plane disposed orthogonal to the width direction. As described above, the fin-side side surface portion 37*d* orthogonal to the width direction is orthogonal to the upper surface 37*a* of the element base portion 37 and the upper surface of the fin portion 24. Since the fin-side side surface portion 37*d* is disposed orthogonal to the width direction, the positioning of the element member 10 with respect to the cloth 2 as described above can be more stably performed. Furthermore, by sewing the element member 10 to the cloth 2 in a state where the side surface portion of the cloth 2 is in contact with the fin-side side surface portion 37*d* of the element base portion 37, the orientation (direction) of the fastener element 20 with respect to the cloth 2 can be further stabilized, so that the fastener element 20 can be effectively prevented from being tilted toward the top surface (upper surface) side or the back surface (lower surface) side of the cloth 2.

The element extending portion 38 of the second element half portion 36 has an extending main body portion 38*a* extending from the element base portion 37 in the width direction so as to approach the coupling counterpart (so as to be separated from the element attaching edge part 3) and a tip raised portion 38*b* integrally provided at a tip end portion of the extending main body portion 38*a* and raising upward.

The extending main body portion 38*a* of the present example is formed to have a smaller thickness dimension than the element base portion 37, and a step is provided between the upper surface 37*a* of the element base portion 37 and the upper surface of the extending main body portion 38*a*. In addition, the extending main body portion 38*a* is formed in a tapered shape in which the length dimension (dimension in the length direction) of the extending main body portion 38*a* gradually decreases as it goes away from the element base portion 37, and exhibits a substantially trapezoidal shape (isosceles trapezoid shape) in a plan view (FIG. 6) of the fastener element 20. In particular, in the present example, a front end edge and a rear end edge of the extending main body portion 38*a* are formed linearly so as to continuously gradually decrease the length dimension of the extending main body portion 38*a* at a constant rate toward the tip end.

In the element member 10 of the present example, a gear insertion gaps 28 into which the teeth 51 of the feeding gear 50 of the sewing machine can be inserted when performing the sewing processing of sewing the element member 10 to the cloth (fastener attached member) 2 as described below (see FIG. 13) is formed between the second element half portions 36 of the fastener elements 20 adjacent in the length direction. In this case, since the extending main body portion 38*a* has a tapered shape as described above, the gear insertion gap 28 formed between the second element half portions 36 can be increased in the length direction as it goes away from the fixing member 11. As a result, for example, the gear insertion gap 28 can be ensured to be wider in the length direction than a gap into which the tooth 51 of the feeding gear 50 can be inserted between the coupling head portions 34 of the first element half portions 31. Therefore, the tooth 51 of the feeding gear 50 of the sewing machine can be deeply inserted into the gear insertion gap 28 between the second element half portions 36. As a result, the second element half portion 36 and the tooth 51 of the feeding gear 50 can be stably engaged with each other.

In addition, in the present example, the length dimension at a proximal end portion of the extending main body portion 38*a* connected to the element base portion 37 is set to 50% or more and 100% or less of the maximum value of the length dimension in the element base portion 37. Furthermore, the length dimension at the tip end portion of the extending main body portion 38*a* is set to 30% or more and 90% or less of the length dimension at the proximal end portion of the extending main body portion 38*a*, or set to 30% or more and 90% or less of the maximum value of the length dimension of the coupling head portion 34 of the first element half portion 31. Since the extending main body portion 38*a* is formed to have the dimensions as described above, the strength of the extending main body portion 38*a* can be stably ensured, and in addition, the gear insertion gap 28 as described above can be stably formed between the element extending portions 38 of the fastener elements 20 adjacent in the length direction.

The tip raised portion 38*b* of the element extending portion 38 is disposed at the tip end portion of the extending main body portion 38*a* and bulges upward from the extending main body portion 38*a* so as to gradually decrease the length dimension. The upper surface of the tip raised portion 38*b* is formed as a flat surface orthogonal to the thickness direction, and is disposed parallel to the upper surface 37*a* of the element base portion 37 at the same height position. That is, the upper surface of the tip raised portion 38*b* is provided so as to be included in a virtual plane obtained by extending the upper surface 37*a* of the element base portion 37 in the width direction. Since the upper surface 37*a* of the element base portion 37 and the upper surface of the tip raised portion 38*b* are disposed so as to be included in the same plane in this manner, when the fastener element 20 is introduced into an element guide path, which will be described below, of the slider 40, each of the upper surfaces of the element base portion 37 and the tip raised portion 38*b* of the fastener element 20 can face the inner surface of an upper blade 42 of the slider 40, so that the direction (orientation) of the fastener element 20 in the element guide path can be stabilized.

Note that, in the present example, a step is provided between the upper surface 37*a* of the element base portion 37 and the upper surface of the extending main body portion 38*a*, and the tip raised portion 38*b* is provided at the tip end portion of the extending main body portion 38*a*. However, in the fastener element of the invention, the element extending portion may be formed without providing the tip raised portion. In addition, in the fastener element of the invention, the element extending portion may be formed such that the upper surface of the element base portion and the upper surface of the extending main body portion form the same continuous plane without providing the step between the element base portion 37 and the extending main body portion 38*a*, and the tip raised portion 38*b*.

On a facing side surface of the element main body portion 21 (the first element half portion 31 and the second element half portion 36) of the present example facing the cloth 2, the fin portion 24 protrudes in a direction parallel to the lower surface 32*a* of the element body portion 32 and the upper surface 37*a* of the element base portion 37. In this case, the fin portion 24 is connected to both the element body portion 32 of the first element half portion 31 and the element base portion 37 of the second element half portion 36. In addition, the lower surface (first fin surface) of the fin portion 24 is disposed below a lower end position of the fixing member 11 in a front view (FIG. 8) of the fastener element 20, and the upper surface (second fin surface) of the fin portion 24 is disposed above an upper end position of the fixing member 11.

The thickness dimension from the upper surface to the lower surface of the fin portion 24 is set to 10% or more and 50% or less of the thickness dimension (that is, the thickness dimension from the upper surface 37*a* of the element base portion 37 to the lower surface 32*a* of the element body portion 32) of the element fixing portion 22. When the thickness dimension of the fin portion 24 is 10% or more of the thickness dimension of the element fixing portion 22, appropriate strength of the fin portion 24 can be stably ensured.

In addition, when the thickness dimension of the fin portion 24 is 50% or less of the thickness dimension of the element fixing portion 22, steps having appropriate height dimensions (dimensions in the height direction) H1 and H2 can be stably provided between the lower surface 32*a* of the element body portion 32 and the lower surface of the fin portion 24 and between the upper surface 37*a* of the element base portion 37 and the upper surface of the fin portion 24.

In this case, by providing the step between the lower surface 32*a* of the element body portion 32 and the lower surface of the fin portion 24, when the slider 40 is slid in the direction of closing the element rows 12, the right and left fastener elements 20 can be stably engaged with right and left lower flange portions 45, which will be described below, of the slider 40 and the right and left fastener elements 20 can be smoothly coupled each other.

In addition, by providing the step between the upper surface 37*a* of the element base portion 37 and the upper surface of the fin portion 24, it is possible to easily align the position of the element member 10 with respect to the element attaching edge part 3 of the cloth 2 when performing the sewing processing of sewing the element member 10 to the element attaching edge part 3 of the cloth 2. In addition, even when the position of the cloth 2 is slightly displaced to the tip end side of the fastener element 20, the cloth 2 can be made difficult to cover the upper surface 37*a* of the element base portion 37. Furthermore, the thickness of the element attaching edge part 3 of the cloth 2 can be accommodated by the step between the upper surface 37*a* of the element base portion 37 and the upper surface of the fin portion 24. As a result, the upper surface of the element attaching edge part 3 can be easily arranged at a height position lower than the upper surface 37*a* of the element base portion 37, so that the element attaching edge part 3 of the cloth 2 can be made less likely to interfere with the slider 40.

In this case, the height dimension H1 of the step formed between the lower surface 32*a* of the element body portion 32 and the lower surface of the fin portion 24 is set to be larger than the height dimension H2 of the step formed between the upper surface 37*a* of the element base portion 37 and the upper surface of the fin portion 24. As a result, when the slider 40 is slid in the direction of closing the slide fastener, the right and left lower flange portions 45, which will be described below, of the slider 40 can be brought into sliding contact with the first element half portion 31 of the fastener element 20 more stably. Note that, in the invention, the formation position of the fin portion 24 in the height direction with respect to the element fixing portion 22 can be arbitrarily changed according to, for example, the thickness of the element attaching edge part 3 of the cloth 2 or the like.

In the present example, the length dimension of the fin portion 24 is set to 50% or more and 100% or less of the length dimension of the element base portion 37 in the second element half portion 36. The width dimension of the fin portion 24 is set to 100% or more and 200% or less of the width dimension of the element base portion 37. When the length dimension of the fin portion 24 is set to 50% or more of the length dimension of the element base portion 37, or the width dimension of the fin portion 24 is set to 100% or more of the width dimension of the element base portion 37, the fin portion 24 sewn to the cloth 2 can be stably brought into surface contact with the cloth 2. Therefore, for example, even when the element member 10 receives an external force in the top and back direction of the cloth 2, the orientation of the fastener element 20 can be stably held, and the fastener element 20 can be prevented from being tilted toward the top surface (upper surface) side or the back surface (lower surface) side of the cloth 2.

In addition, when the length dimension of the fin portion 24 is set to 100% or less of the length dimension of the element base portion 37, an appropriate space portion can be provided between the fin portions 24 of the fastener elements 20 adjacent in the length direction, so that when the element member 10 is attached to the element attaching edge part 3 of the cloth 2 by the sewing processing as described below, the sewing processing can be smoothly and stably performed without bringing the sewing needle into contact with the fin portion 24.

Furthermore, when the length dimension of the fin portion 24 is set to 100% or less of the length dimension of the element base portion 37 and the width dimension of the fin portion 24 is set to 200% or less (preferably 150% or less) of the width dimension of the element base portion 37, when the element member 10 is sewn to the element attaching edge part 3 of the cloth 2, it is possible to prevent the contact range between the hard fin portion 24 and the element attaching edge part 3 of the cloth 2 from becoming too large. Thus, the element attaching edge part 3 to which the element member 10 is sewn can have appropriate flexibility.

In the fin portion 24 of the present example, one through-hole 24*a* penetrating in the top and back direction of the cloth 2 (the thickness direction of the fastener element 20) is formed. The through-hole 24*a* is a portion through which a sewing needle is inserted in the sewing processing of sewing the element member 10 to the element attaching edge part 3 of the cloth 2, and in addition, a sewn portion 15 described below can be pierced into the cloth 2 at the position of the through-hole 24*a*. As a result, the fin portion 24 of the fastener element 20 can be firmly fixed to the cloth 2 by the sewn portion 15, and the fastener element 20 can maintain a predetermined orientation more stably. In the present example, in order to stably insert the sewing needle through the through-hole 24*a*, the through-hole 24*a* of the fin portion 24 is preferably formed in a circular shape having a diameter of 1 mm or more in a plan view of the fastener element 20.

In addition, in the fin portion 24 of the present example, an accommodating recessed groove portion 24*b* for accommodating the sewing thread of the sewn portion 15 is recessed on the lower surface of the fin portion 24. The accommodating recessed groove portion 24*b* is formed along the length direction from the front end edge to the rear end edge of the fin portion 24, and is connected to the through-hole 24*a* provided in the fin portion 24. When the accommodating recessed groove portion 24*b* is provided, the sewing thread of the sewn portion 15 can be accommodated and held in the accommodating recessed groove portion 24*b*. Thus, since the sewing thread held in the accommodating recessed groove portion 24*b* of the fin portion 24 can be made less likely to come into contact with the slider 40, cutting of the sewing thread due to the contact with the slider 40 can be made less likely to occur even when the sliding operation of the slider 40 is repeatedly performed.

The fastener element 20 of the present example having the above-described form is integrally formed with the fixing member 11 by performing injection molding using a mold having a fixed mold and a movable mold that are separated vertically. On the other hand, for example, in the case of the fastener element 82 described in Patent Document 1, since a recessed groove portion along the length direction is provided at the tip end portion of the coupling head portion, the mold used for injection molding needs to include a fixed mold, a movable mold, and a slide core. Therefore, since the fastener element 20 of the present example can be molded using a mold having a simpler structure than in the case of the fastener element 82 of Patent Document 1, the manufacturing cost can be reduced.

In the element member 10 of the present example, a gap over which the fixing member 11 is exposed is formed between the element fixing portions 22 of the fastener elements 20 adjacent in the length direction. In each of the gaps between the fastener elements 20, when the element member 10 is sewn to the cloth (fastener attached member) 2 by the sewn portion 15, the exposed fixing member 11 is firmly held and fixed by the sewn portion 15.

In the present example, each of the right and left element members 10 is attached to the opposing edge parts of the cloth 2 cut into a predetermined shape by the sewn portion 15 of the sewing thread. The sewn portion (sewing line) 15 for fixing the element member 10 is continuously formed by lock-stitching by performing the sewing processing using a zig-zag sewing machine.

Figure 13:
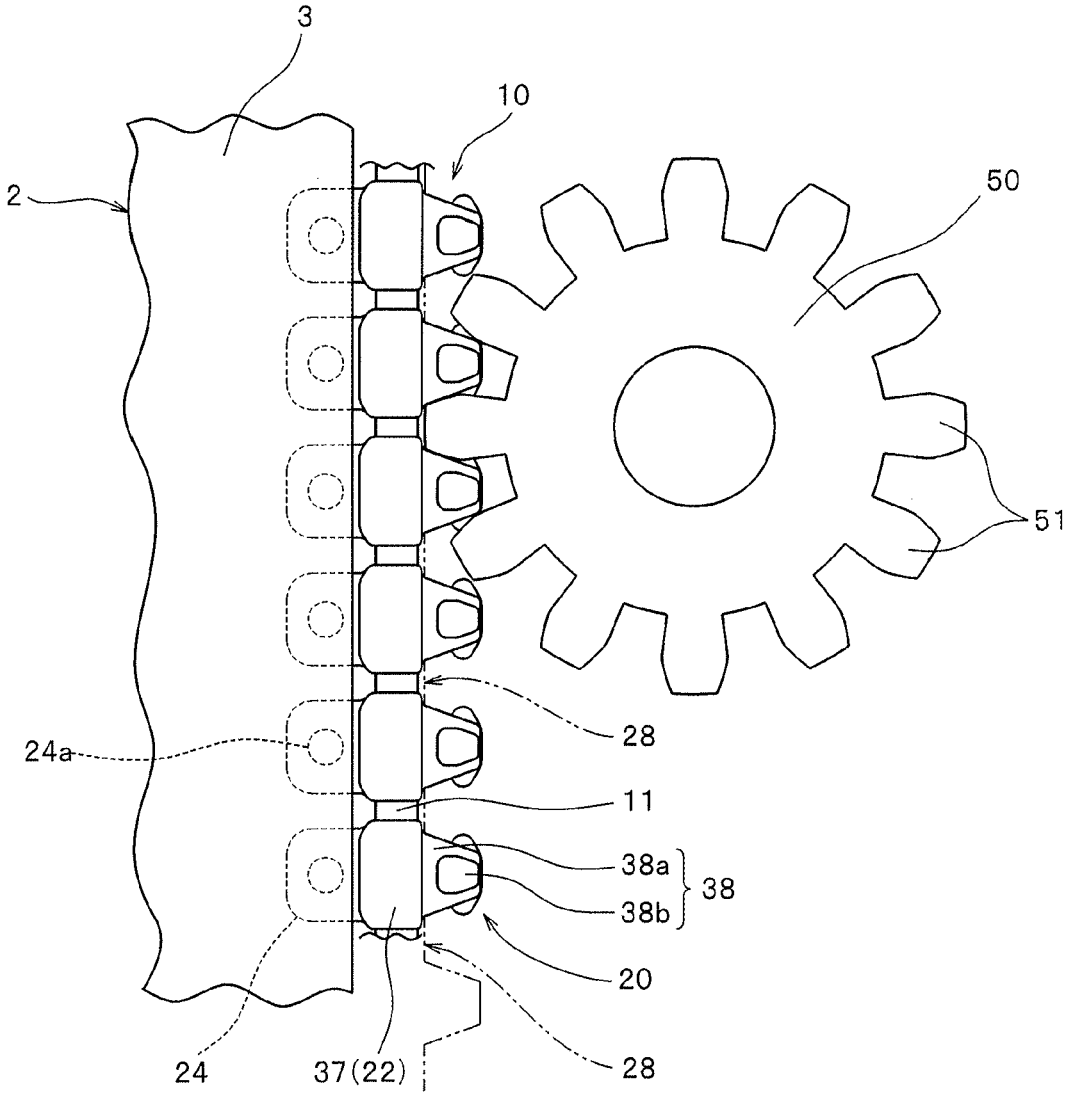
FIG. 13 is an explanatory view schematically explaining sewing processing of sewing an element member to a fastener attached member (cloth).

Here, the zig-zag sewing machine is a sewing machine capable of sewing the cloth 2 and the like by lock-stitching while swinging the sewing needle in a crossing direction that crosses a feeding direction of the sewing machine using a sewing thread including an upper thread (needle thread) and a lower thread (bobbin thread). The zig-zag sewing machine used in the present example is provided with a needle plate, which is not shown, feed dogs, which are not shown, that feed the cloth 2 and the element member 10 to the downstream side, and the feeding gear 50 as shown in FIG. 13 that rotates in synchronization with the feeding operation by the feed dogs. In addition, an insertion groove portion through which a part of the fastener element 20 is inserted is formed in the needle plate, which is not shown, along the feeding direction of the element member 10.

In this case, the feeding gear 50 has a plurality of teeth 51 that can be inserted into the gear insertion gaps 28 formed between two fastener elements 20 adjacent in the length direction of the element member 10. In addition, when viewed from above with the feeding direction of the cloth 2 and the element member 10 set to the front side (see FIG. 13), the feeding gear 50 is disposed at a predetermined position on the right side of the position of the sewing needle, and is disposed at a predetermined height position at which it is possible to couple with the second element half portion 36 of the fastener element 20.

The feeding gear 50 rotates in the clockwise direction while sequentially inserting the plurality of teeth 51 of the feeding gear 50 into the gear insertion gaps 28 formed between the second element half portions 36 of the element member 10. As a result, the element member 10 can be stably fed to the front side (above side on the sheet of paper of FIG. 13) together with the feed dogs, which are not shown, of the zig-zag sewing machine in accordance with the raising and lowering movement of the sewing needle.

In addition, when the element member 10 is sewn to the element attaching edge part 3 of the cloth 2 using the zig-zag sewing machine, coordinate data of needle locations 55 as indicated by a virtual line circle in FIG. 3 is set in advance in the zig-zag sewing machine. In the case of the present example, coordinate data is set such that the sewing thread is pierced through the element attaching edge part 3 of the cloth 2 at the position of the through-hole 24*a* provided in the fin portion 24 of each of the fastener elements 20 and the position of each of the gaps formed between the fin portions 24 corresponding to the through-hole 24*a*, and the sewing threads (the upper thread and the lower thread) are crossed (interlaced) at a position in contact with the outer peripheral surface of the fixing member 11. Note that the needle locations 55 with respect to the element member 10 and the cloth 2 is not limited to the positions shown in FIG. 3, and can be arbitrarily changed.

When the sewing processing is performed on the element member 10 of the present example and the cloth 2 using the zig-zag sewing machine as described above, first, the element member 10 and the cloth 2 are set on the needle plate of the zig-zag sewing machine in a state where the element member 10 is arranged at a position adjacent to the outer side in the width direction of the element attaching edge part 3 along the element attaching edge part 3 with respect to the cloth 2. At this time, the cloth 2 is placed on the upper surface of the fin portion 24 of each of the fastener elements 20. Furthermore, the element member 10 is held in a predetermined positional relationship with respect to the cloth 2 by bringing the side surface portion of the cloth 2 into contact with the step formed between the upper surface 37*a* of the element base portion 37 and the upper surface of the fin portion 24 in the fastener element 20.

After the element member 10 and the cloth 2 are set on the sewing machine as described above, the sewing processing of sewing the element member 10 to the element attaching edge part 3 of the cloth 2 is performed by raising and lowering the sewing needle according to the coordinate data set in advance while feeding the element member 10 and the cloth 2 with the feed dogs and the feeding gear 50 of the zig-zag sewing machine.

At this time, in the element member 10 of the present example, as described above, the first element half portion 31 including the coupling head portion 34 and the second element half portion 36 are formed asymmetrically in the height direction, and the element extending portion 38 (extending main body portion 38*a*) of the second element half portion 36 is formed in a tapered form. Therefore, each of the gear insertion gaps 28 is provided relatively widely in the length direction between the second element half portions 36 of the fastener elements 20 adjacent in the length direction.

Figure 17:
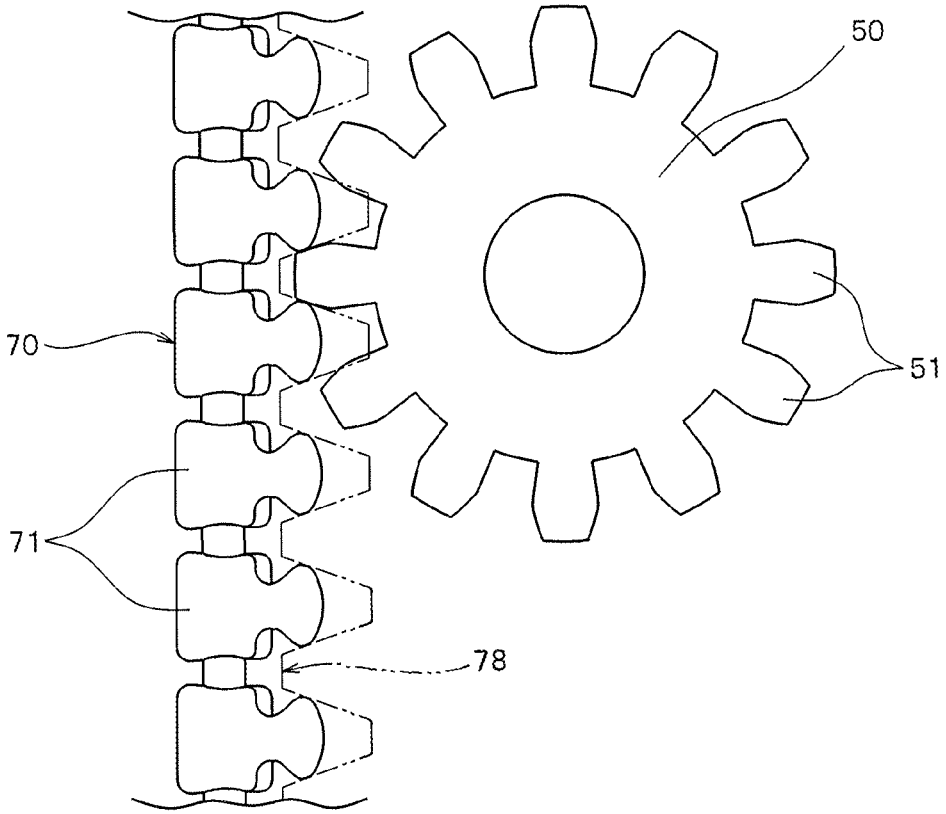
FIG. 17 is an explanatory view schematically explaining sewing processing of sewing a conventional element member to a cloth.

Here, FIG. 17 schematically shows a state of coupling between fastener elements 71 and teeth 51 of a feeding gear 50 in a case where a conventional element member 70 is fed by feed dogs, which are not shown, and the feeding gear 50 of a sewing machine. In the case of the conventional element member 70, gear insertion gaps 78 into which the teeth 51 of the feeding gear 50 can be inserted is provided between the fastener elements 71 adjacent in the length direction as indicated by the two-dot chain line in FIG. 17. However, in this case, since the coupling head portion of the fastener element 71 is formed in a substantially oval shape elongated in the length direction, the size of the gear insertion gap 78 is narrowed by the coupling head portion. Therefore, the insertion depth of the tooth 51 of the feeding gear 50 inserted into the gear insertion gap 78 is limited by the coupling head portion.

On the other hand, in the case of the element member 10 of the present example, as indicated by the two-dot chain line in FIG. 13, the gear insertion gap 28 provided between the second element half portions 36 can be formed in a range in the height direction different from the coupling head portion 34 of the first element half portion 31.

Furthermore, the gear insertion gap 28 can be formed to be larger in the length direction than the gear insertion gap 78 shown in FIG. 17. As a result, the teeth 51 of the feeding gear 50 can be inserted deeper between the fastener elements 20 of the element member 10 of the present example. Thus, the fastener element 20 of the element member 10 and the feeding gear 50 can be firmly coupled.

Therefore, the fastener elements 20 can be smoothly fed and the fastener elements 20 can be stably supported by the feeding gear 50. Accordingly, the element member 10 can be effectively prevented from swinging in the right and left direction or twisting at the time of the sewing processing, and the element member 10 can be stably sewn to the element attaching edge part 3 of the cloth 2. As a result, the workability and work efficiency of the sewing processing can be improved.

Then, by performing sewing while feeding the element member 10 and the cloth 2 with the zig-zag sewing machine, the element member 10 can be firmly fixed to the element attaching edge part 3 of the cloth 2 by the sewn portion 15 formed by lock-stitching. In addition, at this time, a part of the sewn portion 15 for fixing the element member 10 is inserted and held in the accommodating recessed groove portion 24*b* provided on the fin portion 24 of the fastener element 20. Note that, although the sewn portion 15 of the present example is formed by lock-stitching, in the invention, the sewn portion for fixing the element member can be formed by other than lock-stitching.

The slider 40 attached to the element rows 12 of the present example includes a slider body 41 and a tab, which is not shown. As schematically shown in FIGS. 10 to 12, the slider body 41 of the present example includes the upper blade 42, a lower blade 43 disposed parallel to and spaced apart from the upper blade 42, a connecting column 44 connecting front end parts (shoulder opening side end parts) of the upper blade 42 and the lower blade 43, the right and left lower flange portions 45 erected on right and left side edge parts of the lower blade 43, and a tab attachment portion 46 provided on the upper surface of the upper blade 42. A tab, which is not shown, is attached to the tab attachment portion 46 of the slider body 41.

At a front end part of the slider body 41, right and left shoulder openings are formed on the right and left sides of the connecting column 44. A rear opening is formed at a rear end part of the slider body 41. Between the upper blade 42 and the lower blade 43, a substantially Y-shaped element guide path communicating the right and left shoulder openings and the rear opening is formed.

In the slider 40 of the present example, the entire lower surface of the upper blade 42 is formed as a flat plane, and the lower surface of the upper blade 42 is not provided with a protruded portion protruding toward the lower blade 43 so as to engage with the fastener element 20. In addition, the right and left lower flange portions 45 stand on the right and left side edge parts of the lower blade 43 so as to be engageable with the fastener elements 20. The height dimension of the lower flange portions 45 from the upper surface (inner surface) of the lower blade 43 is set corresponding to the size of the step in the height direction provided between the lower surface 32*a* of the element body portion 32 and the lower surface of the fin portion 24 of the fastener element 20.

Furthermore, the upper blade 42 of the present example is formed to have a width dimension smaller than that of the lower blade 43, and the right and left side end edges of the upper blade 42 are disposed inside the right and left side end edges of the lower blade 43 in the width direction in the entire length direction of the slider 40 in a plan view (FIG. 11) of the slider 40 viewed from above. In particular, in this case, the right and left side end edges of the upper blade 42 are disposed at positions of overlapping the inner edges of the right and left lower flange portions 45 or slightly inside the right and left lower flange portions 45 in the width direction in a plan view of the slider 40. That is, in plan view of the slider 40, the right and left lower flange portions 45 are disposed to be exposed outside in the width direction from the upper blade 42.

Note that the upper blade 42 is preferably formed such that the width dimension between the right and left side end edges of the upper blade 42 is 50% or more, particularly 60% or more of the width dimension at the corresponding position of the lower blade 43. As a result, the fastener elements 20 introduced into the element guide path of the slider body 41 are appropriately covered (or held) by the upper blade 42 from the upper surface side, and the fastener elements 20 can be prevented from coming out of the gaps between the upper blade 42 and the lower flange portions 45 to the outside.

By means of the upper blade 42 of the present example being formed to be smaller in width dimension than the lower blade 43 as described above, when the fastener elements 20 are introduced into the element guide path of the slider body 41, as shown in FIG. 2, the element attaching edge parts 3 of the cloth 2 to which the element members 10 are sewn can be arranged at positions outside the right and left side end edges of the upper blade 42. As a result, even when the thickness of the element attaching edge part 3 of the cloth 2 is larger than, for example, the step in the height direction provided between the upper surface 37*a* of the element base portion 37 and the upper surface of the fin portion 24 of the fastener element 20, the element attaching edge part 3 of the cloth 2 will not be sandwiched between the upper blade 42 and the lower flange portion 45 of the slider 40. In addition, it is also possible to prevent the element attaching edge part 3 from interfering with the upper blade 42 of the slider 40. Therefore, it is possible to prevent the slidability and operability of the slider 40 from deteriorating due to the thickness of the element attaching edge part 3 of the cloth 2, and it is possible to prevent trouble from occurring in the sliding operation of the slider 40.

With the clothing 1 of the present example in which the element members 10 as described above are sewn to the right and left element attaching edge parts 3 of the cloths 2, it is possible to have the function of a slide fastener in a form in which the presence of the fastener tape, which is essential in the conventional slide fastener, is omitted. As a result, regarding the slide fastener-attached clothing 1, it is possible to reduce the manufacturing cost, reduce the weight of the clothing 1, and improve the flexibility of the clothing 1.

In addition, in the clothing 1 of the present example, the fin portion 24 of each of the fastener elements 20 is fixed to the cloth 2 by the sewn portion 15 in a state of being in surface contact with the cloth 2. Therefore, the orientation of the fastener element 20 can be stably held by the fin portion 24 such that the upper surface 37*a* and the lower surface 32*a* of the element fixing portion 22 are parallel to the top surface and the back surface of the cloth 2. Therefore, for example, even when an external force is applied to the element member 10, it is possible to prevent the orientation of the fastener element 20 from being tilted with respect to the cloth (fastener attached member) 2. As a result, the sliding operation of the slider 40 can be smoothly performed. Therefore, the slide fastener integrally formed with the clothing 1 can be stably opened and closed.

Furthermore, in the clothing 1 of the present example, when the slider 40 is slid, the lower flange portions 45 of the slider 40 move along the length direction while being in sliding contact with the fin portions 24 of the plurality of fastener elements 20, or move along the length direction at a position approaching the fin portions 24. On the other hand, the accommodating recessed groove portion 24*b* along the length direction is recessed in the fin portion 24 of the fastener element 20. Furthermore, the sewing thread of the sewn portion 15 is accommodated in the accommodating recessed groove portion 24*b*. Accordingly, since the lower flange portions 45 of the slider 40 can be prevented from being rubbed against the sewn portion 15 when the slider 40 slides, even when the sliding operation of the slider 40 is repeatedly performed, the sewing thread can be prevented from being cut due to the contact with the lower flange portions 45 of the slider 40.

Note that, in the above-described example, the element member 10 is sewn to the cloth 2 by the sewn portion 15 by performing the sewing processing in a state where the cloth 2 is in contact with the upper surfaces of the fin portions 24 of the fastener elements 20. In this case, the accommodating recessed groove portion 24*b* formed in the fin portion 24 of the fastener element 20 to accommodate the sewn portion 15 is provided on the lower surface of the fin portion 24 on the side not contacting the cloth 2 as shown in FIG. 8.

Figure 14:
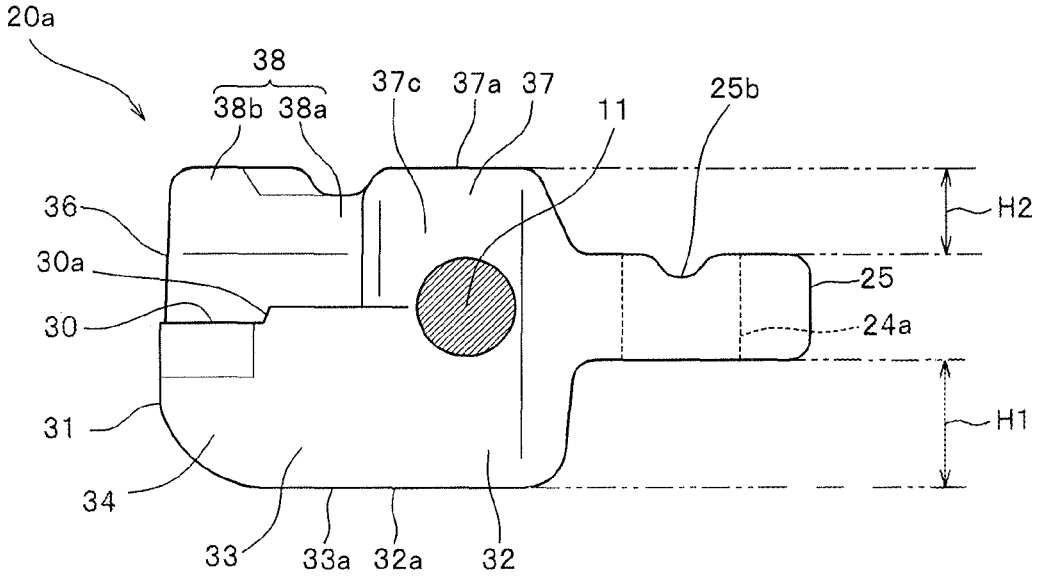
FIG. 14 is a front view of a fastener element according to a modification example as viewed from a length direction.

However, in the invention, for example, as shown in a front view of a fastener element 20*a* according to a modification example in FIG. 14, an accommodating recessed groove portion 25*b* for accommodating the sewn portion may be provided along the length direction on the upper surface of a fin portion 25 of the fastener element 20*a*. In this case, the accommodating recessed groove portion 25*b* is connected to a through-hole 24*a* provided in the fin portion 25. Note that, in FIG. 14 and FIG. 15 described below, portions or members having substantially the same forms or structures as those of the element member 10 according to the above-described example are denoted by the same reference numerals, and the description thereof will be omitted.

As shown in FIG. 14, in a case where the accommodating recessed groove portion 25*b* is provided on the upper surface of the fin portion 25, an element member having the fastener elements 20*a* can be sewn to a cloth by performing the sewing processing in a state where the cloth is in contact with the lower surfaces of the fin portions 25 of the fastener elements 20*a*. In addition, since the sewing thread of the sewn portion can be accommodated in the accommodating recessed groove portion 25*b* provided on the upper surface of the fin portion 25, the sewing thread can be made difficult to come into contact with the slider.

Note that, in the fastener element 20*a* shown in FIG. 14, a height dimension H1 of a step formed between a lower surface 32*a* of an element body portion 32 and the lower surface of the fin portion 25 is larger than a height dimension H2 of a step formed between an upper surface 37*a* of an element base portion 37 and the upper surface of the fin portion 25. However, in the slide fastener-attached product formed of the element member having the fastener elements 20*a* shown in FIG. 14, the flange portion (upper flange portion) of the slider is disposed on the upper surface side of the fin portion 25. Therefore, in the invention, regarding the fastener element 20*a* shown in FIG. 14, for example, the height dimension H2 of the step formed between the upper surface 37*a* of the element base portion 37 and the upper surface of the fin portion 25 can be made larger than the height dimension H1 of the step formed between the lower surface 32*a* of the element body portion 32 and the lower surface of the fin portion 25. As a result, when the slider is slid in the direction of closing the slide fastener, the flange portions provided on the slider can be more stably slidably brought into contact with the fastener element 20*a*, and the right and left fastener elements can be coupled.

In addition, in the fastener element 20 of the above-described example, as shown in FIG. 8, the fin portion 24 is provided such that the lower surface of the fin portion 24 is disposed below the lower end position of the fixing member 11 in the height direction. As a result, the fin portion 24 can be formed with an appropriate thickness, and the step between the upper surface 37*a* of the element base portion 37 and the upper surface of the fin portion 24 can be formed such that the height dimension H2 of the step has a size capable of accommodating the thickness of the cloth 2.

Figure 15:
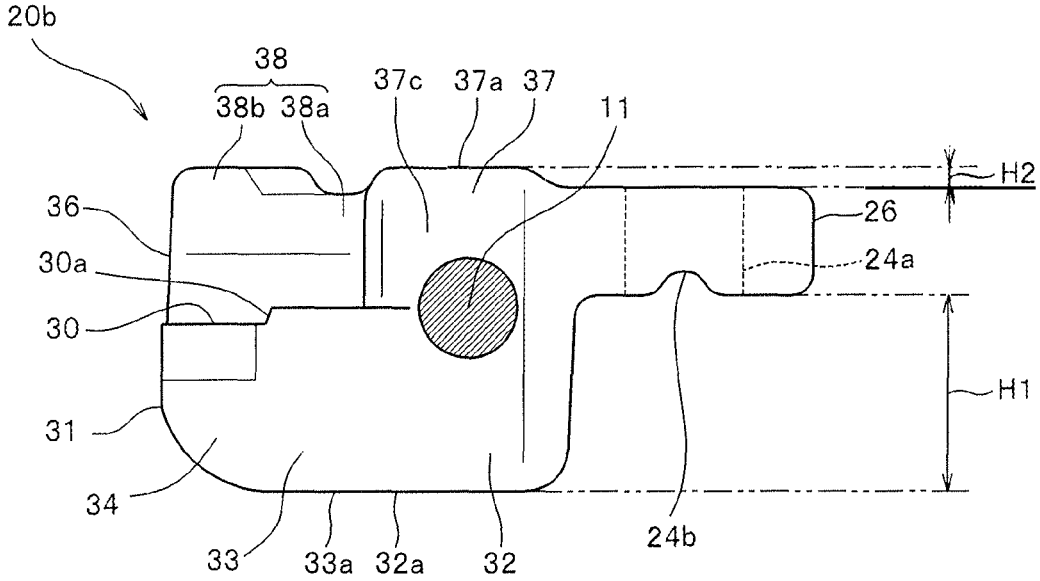
FIG. 15 is a front view of a fastener element according to another modification example as viewed from a length direction.
Figure 16:
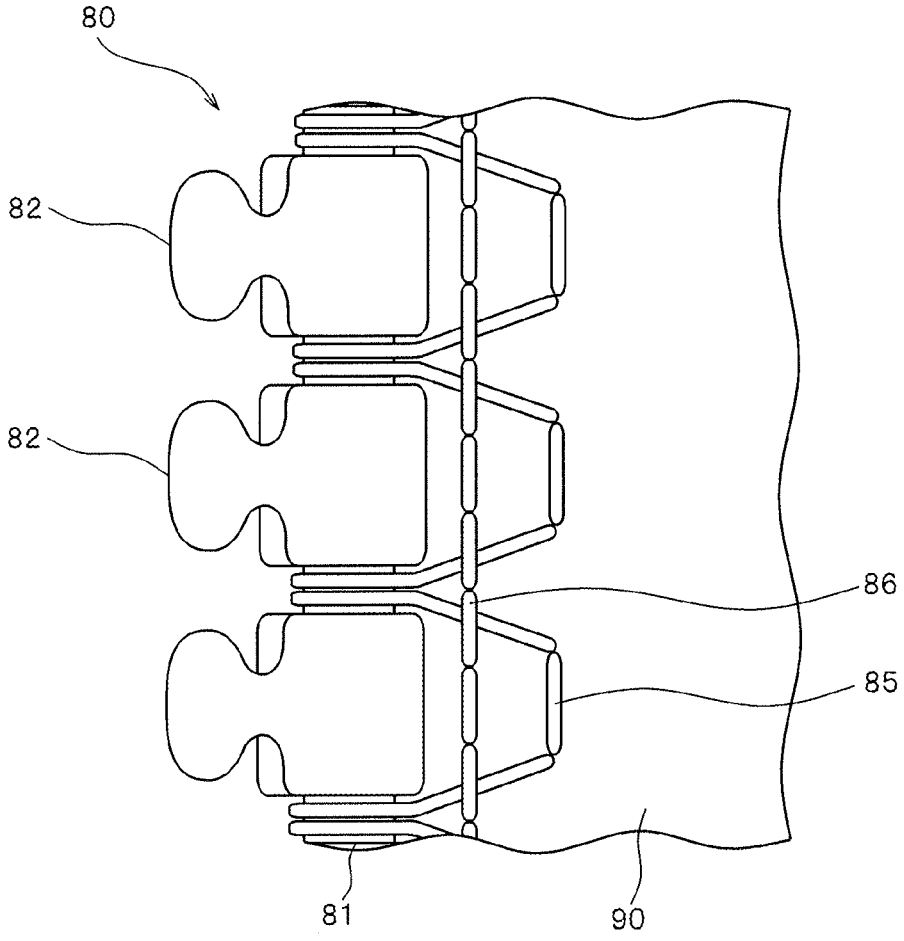
FIG. 16 is a plan view showing a conventional slide fastener-attached product.

However, in the invention, as described above, the formation position of the fin portion in the fastener element can be changed in the height direction. For example, in the invention, as FIG. 15 shows a front view of a fastener element 20*b* according to another modification example, a fin portion 26 of the fastener element 20*b* can be provided at a position above that of the fastener element 20 according to the example shown in FIG. 8, for example. In the case of the fastener element 20*b* shown in FIG. 15, the fin portion 26 is formed such that the lower surface of the fin portion 26 is disposed above the lower end position of a fixing member 11 in the height direction.

As a result, in the fastener element 20*b* of FIG. 15, although the above-described height dimension H2 is smaller as compared with that of the fastener element 20 according to the example of FIG. 8, the above-described height dimension H1 can be larger. Therefore, when the slider is slid in the direction of closing the slide fastener, right and left lower flange portions provided on the slider can be brought into sliding contact with a first element half portion 31 of the fastener element 20*b* more stably. Therefore, the right and left fastener elements 20*b* can be more stably coupled.

Furthermore, in the invention, although illustration is omitted, for example, the fin portion of the fastener element can be provided at a position further above that of the fastener element 20*b* of FIG. 15 so that the upper surface of the element base portion and the upper surface of the fin portion are provided at the same height position to form a single plane. In this case, although the thickness of the cloth cannot be accommodated in the fastener element, the right and left lower flange portions provided on the slider can be brought into sliding contact with the first element half portion (element lower half portion) of the fastener element more stably.

REFERENCE SIGNS LIST

1 Slide fastener-attached clothing (slide fastener-attached product)
2 Cloth (fastener attached member)
3 Element attaching edge part
10 Element member
11 Fixing member
12 Element row
15 Sewn portion
20 Fastener element
20*a*, 20*b* Fastener element
21 Element main body portion
22 Element fixing portion
23 Coupling portion
24 Fin portion
24*a* Through-hole
24*b* Accommodating recessed groove portion
25 Fin portion
25*b* Accommodating recessed groove portion
26 Fin portion
28 Gear insertion gap
30 Boundary
30*a* Step
31 First element half portion (element lower half portion)
32 Element body portion
32*a* Lower surface (first element surface)
33 Element neck portion
33*a* Lower surface (first element surface)
34 Coupling head portion
36 Second element half portion (element upper half portion)
37 Element base portion
37*a* Upper surface (second element surface)
37*b* Front end surface
37*c* Rear end surface
37*d* Fin-side side surface portion
38 Element extending portion
38*a* Extending main body portion
38*b* Tip raised portion
40 Slider
41 Slider body
42 Upper blade
43 Lower blade
44 Connecting column
45 Lower flange portion
46 Tab attachment portion
50 Feeding gear
51 Tooth
55 Needle location
H1 Height dimension of step formed between lower surface of element body portion and lower surface of fin portion
H2 Height dimension of step formed between upper surface of element base portion and upper surface of fin portion

The invention claimed is:

1. An element member including a fixing member and a plurality of fastener elements attached to the fixing member, wherein:

each of the plurality of fastener elements includes an element fixing portion fixed to the fixing member, a coupling portion extending from the element fixing portion in a width direction orthogonal to a length direction of the fixing member, and a fin portion extending from the element fixing portion to a side opposite to the coupling portion, the fin portion defining a through-hole, the through-hole penetrating in a height direction orthogonal to the length direction and the width direction; and each of the plurality of fastener elements is fixed to the fixing member only at the element fixing portion.

2. The element member according to claim 1, wherein the fin portion includes a first fin surface and a second fin surface orthogonal to the height direction, and an accommodating recessed groove portion provided along the length direction on any one of the first fin surface and the second fin surface.

3. The element member according to claim 1, wherein:

each of the plurality of fastener elements includes a first element half portion disposed on one side in a height direction orthogonal to the length direction and the width direction and a second element half portion disposed on the other side in the height direction, the first element half portion and the second element half portion have asymmetric shapes in the height direction with respect to each other, and the first element half portion includes an element body portion forming a part of the element fixing portion, and an element neck portion and a coupling head portion forming the coupling portion.

4. The element member according to claim 3, wherein:

the second element half portion includes an element base portion forming the element fixing portion together with the element body portion, and an element extending portion extending from the element base portion in the width direction, the element base portion is formed to have a constant size in length dimension in a range of 80% or more in a fixing region in the width direction fixed to the fixing member of the element base portion when the corresponding fastener element is viewed from the other side in the height direction, and a length dimension of the element extending portion gradually decreases in a direction away from the element base portion.

5. The element member according to claim 3, wherein:

each of the plurality of fastener elements has a first end surface of the first element half portion disposed on one side in the height direction and a second end surface of the second element half portion disposed on the other side in the height direction, and a step between the first end surface of the first element half portion and the fin portion in the height direction is larger than a step between the second end surface of the second element half portion and the fin portion in the height direction.

6. A slide fastener-attached product including: a pair of two element members according to claim 1; a fastener attached member including a pair of element attaching edge parts to which the element member is attached each provided at positions facing each other, and a slider slidably attached to an element row formed by the plurality of the fastener elements.

7. The slide fastener-attached product according to claim 6, wherein:

the slider includes an upper blade, a lower blade disposed apart from the upper blade, a connecting column connecting one end part of the upper blade and one end part of the lower blade, and lower flange portions disposed at right and left side edge parts of the lower blade, and right and left side end edges of the upper blade are disposed inside right and left side end edges of the lower blade in the width direction in a plan view of the slider viewed from above.

8. The element member according to claim 1, wherein the fin portion includes a first fin surface disposed on one side in the height direction of the fin portion and a second fin surface disposed on the other side in the height direction, and an accommodating recessed groove portion provided along the length direction on any one of the first fin surface and the second fin surface.

* * * * *